United States Patent [19]

Benavente et al.

[11] Patent Number: 4,901,739

[45] Date of Patent: Feb. 20, 1990

[54] FOLDING, DISPOSABLE RECEPTACLE FOR RUBBISH, SUCH AS AN ASHTRAY OR A WASTE BIN

[76] Inventors: Roberto Benavente, 13, Rue deL'Abbee Rousseau, F-78000 Versailles; Jean-Baptiste Lacoudre, 21, Rue du Faubourg Sainte Antoine, F-75011 Paris; Catherine Vialatel, 21, Rue du Faubourg Sainte Antoine, F-75011 Paris, all of France

[21] Appl. No.: 201,550

[22] Filed: Jun. 2, 1988

[30] Foreign Application Priority Data

Jun. 3, 1987 [FR] France ..... 87 07766

[51] Int. Cl.[4] ..... A24D 1/00

[52] U.S. Cl. ..... 131/231; 131/174

[58] Field of Search ..... 131/231, 174

[56] References Cited

U.S. PATENT DOCUMENTS

| | | | |
|---|---|---|---|
| 1,364,556 | 1/1921 | Hurff | 131/231 |
| 2,071,394 | 2/1937 | Douglas | 131/231 |
| 3,342,317 | 9/1967 | Barron | 131/231 X |
| 3,372,724 | 3/1968 | Rouse | 131/231 |
| 4,349,036 | 9/1982 | Harvey et al. | 131/231 X |

*Primary Examiner*—Vincent Millin
*Assistant Examiner*—J. L. Doyle
*Attorney, Agent, or Firm*—Peter K. Kontler

[57] ABSTRACT

Receptacle constituted by an envelope (1) of thin, flexible material, defined by two rectangular side walls (2, 3) and by two lozenge-shaped bounding walls (4), provided with a longitudinal fold line (6) and a transverse fold line (7) and connected to the side walls (2, 3) by fold lines (10) in such a way as to permit locking in open position, the top wall (4) having two holes (12) in the region of the acute angles of the lozenge.

11 Claims, 3 Drawing Sheets

FOLDING, DISPOSABLE RECEPTACLE FOR RUBBISH, SUCH AS AN ASHTRAY OR A WASTE BIN

The present invention relates to a folding, disposable receptacle for rubbish, such as an ashtray or a waste bin.

At the present time the cleaning of ashtrays, particularly in office premises, raises a problem of cleanliness. In fact, to clean an ashtray properly, it is necessary to empty it, that is to say to get rid of the butts and the ash, and then to wash it. Such cleaning is usually imperfect in the sense that residues of ash and of tar very often remain on the ashtrays. Moreover, in premises having a large number of offices, the repeated emptying of a large number of ashtrays causes discomfort, indeed a hygiene problem, for the maintenance personnel, having regard to the impossibility of preventing the ashes from escaping.

Similar problems arise for the cleaning of waste bins in offices.

Moreover, it often happens that smokers do not find ashtrays available for them everywhere, which leads them to shed ash and to stub out the butts of their cigarettes on the floor.

The present invention has as its subject a folding, disposable receptacle which can serve in particular as an ashtray or as a waste bin, this receptacle being light, of small bulk when folded, and able to be manufactured at a low price so as to be able to be thrown away after use. The invention also has as it$ subject a folding, disposable receptacle which can be made up starting from a blank of material, by folding and sticking. The invention further has as its subject a folding, disposable receptacle having closure means preventing the spread of the contents of the receptacle when the latter is thrown away.

The folding, disposable receptacle for rubbish, according to the invention, is constituted by an envelope of thin, flexible material, defined by two rectangular side walls connected to each other along two first opposed edges, and by two lozenge-shaped bounding walls connected to the side walls along their edges in the region of two second opposed edges of the side walls, in such a way that the obtuse angles of the lozenge lie on the second opposed edges of the side walls, in the middle of the length of these second edges, and that the acute angles of the lozenge lie on the first edges of the side walls, offset relative to the second edges, each bounding wall having a longitudinal central fold line and a transverse central fold line extending over the whole length and the whole width of the wall, one of the bounding walls having two holes lying in the region of the two acute angles of the lozenge.

Before use, the receptacle is folded flat, each bounding wall being folded in two along its central longitudinal line and arranged in the shape of a bellows between the two side walls. In order to use the receptacle, that is to open it, force is exerted on the two first opposed edges of the side walls in such a way as to move the said two edges towards each other. This force causes separation of the two side walls in their central part and unfolding of the bounding walls along their longitudinal central line and finally a reversal of the bounding walls, that is to say reverse folding along the central transverse lines, when the separation of the side walls, in their central part, becomes as great as the length of the transverse lines of the bounding walls, thus causing locking of the bounding walls in this reversed position, and thus of the receptacle in open position thanks to the resilience of the side walls. In this open position, the bounding wall provided with holes, which serves as the top wall, has the shape of a roof with two slopes, the ridge line of which coincides with the transverse central fold line, the two slopes of the roof extending downwards in the direction of the acute angles of the lozenge, being the angle at which the top wall is provided with two holes.

The receptacle according to the invention may advantageously be made up starting from a flat blank of generally rectangular shape, of a thin, resiliently flexible material, in which four rectangular panels are arranged side by side, being connected to each other along parallel fold lines, each second panel also having four fold lines in a lozenge shape and also a central longitudinal fold line and a central transverse fold line, one of the said panels having two holes in the neighborhood of the acute angles of the lozenge and one of the said panels which is at a boundary of the blank having a flap for fixing by sticking, along its free longitudinal edge, while one of the other panels has two flaps for fixing by sticking, along its two opposed free edges.

The erection of the receptacle starting from such a blank is extremely simple, because it suffices to fold the second panels into bellows along their longitudinal central fold line and to stick the three fixing flaps to their counterparts on the folded blank.

To assist the locking of the receptacle in open position, it is advantageous for the transverse central fold line of the second panels to be preformed in the blank in the direction opposite to the other fold lines of the panels.

To keep the receptacle closed in its upper part, after use, it is advantageous to provide the bounding panel with coatings of contact adhesive in its parts situated outside the lozenge.

Thus, after use, before throwing the receptacle away, it suffices to flatten the latter in its upper part so that the opposed edges of the upper panel of the receptacle having holes in it adhere to each other above the holes and thus prevent the contents of the receptacle from scattering.

Referring to the accompanying schematic drawings, what will be described below in more detail is an embodiment, exemplary and not limiting, of a receptacle according to the invention, used as an ashtray. In these drawings.

Figure 1:
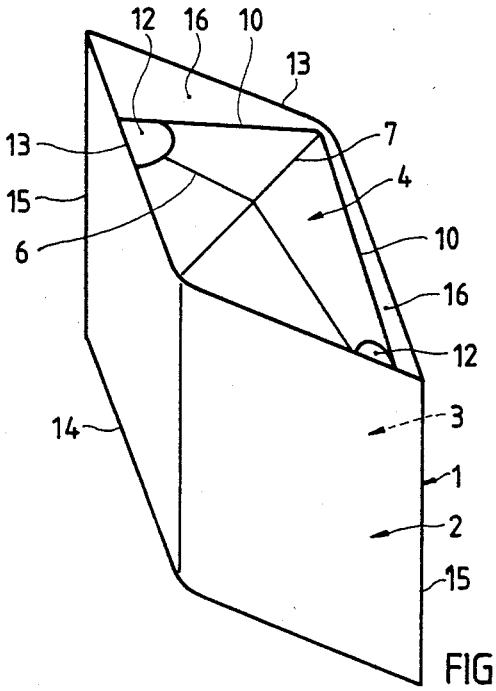
FIG. 1 is a view in axonometric perspective of the receptacle according to the invention, in open position.

The receptacle shown in the drawings, intended to be used as an ashtray, consists of an envelope 1 constituted by two opposed side walls 2, 3, of generally rectangular shape, and also a top wall 4 and a bottom wall 5 in the general shape of a lozenge.

The top wall 4 has a central longitudinal fold line 6 and a central transverse fold line 7. Likewise, the bottom wall 5 has a central longitudinal fold line 8 and a central transverse fold line 9.

The top wall 4 and the bottom wall 5 link up with each of the two side walls 2 and 3 along two fold lines 10 forming, when the diamond or lozenge-shaped wall 4 is folded in two along the line 6, the two sides of an isosceles triangle, the base of which is constituted by the fold line 6. Consequently, the apex of this isosceles triangle which corresponds to the obtuse angle of the lozenge-shaped wall 4 lies at the level of the upper edge 13 of the side wall 2, 3, while the lateral angles of the isosceles triangle corresponding to half of the acute angles of the lozenge-shaped wall 4 are offset downwards relative to the upper edge 13 of the side walls 2, 3.

Likewise, the lozenge-shaped bottom wall 5 is connected to each side wall 2, 3 by two lines 11 corresponding to the lines 10 of the top wall 4, with the slight difference that the obtuse angles of the lozenge-shaped bottom wall 5 lie at the level of the lower edge 14 of the side walls 2, 3 and that the acute angles of the lozenge-shaped bottom wall 5 lie offset upwards relative to the said lower edge 14.

In addition, in the region of each of its acute angles, the lozenge-shaped top wall 4 has a hole 12 enabling the interior of the receptacle to communicate with the exterior.

Figure 2:
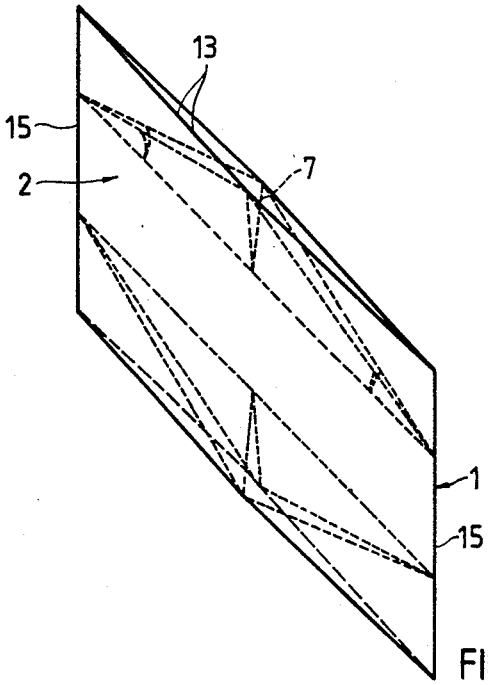
FIG. 2 is a view in axonometric perspective of the receptacle according to the invention, in closed position.

Thanks to this formation of the top and bottom walls 4, 5 and to the connection of these walls 4 and 5 with the side walls 2 and 3, the envelope 1 can assume a folded position, shown in FIG. 2, in which the two side walls 2 and 3 are flat and enclose between them the top and bottom walls 4 and 5, folded in two in the shape of bellows along the central longitudinal fold lines 6, 8. Starting from this folded position, by simple pressure exerted on the two opposed vertical edges 15 of the side walls 2, 3 in the direction of bringing these edges 15 closer to each other, the envelope can be brought to the open position according to FIG. 1 in which the wall 4 is held locked in the position unfolded along the longitudinal line 6, between the side walls 2, 3, under the effect of the resilience of these walls. In this position the top wall 4 is folded along the central transverse fold line 7 in the form of a roof with two slopes, the ridge line of which coincides with the transverse fold line 7. Conversely, the bottom wall 5 is folded, in this position, along the transverse fold line 9, with two slopes directed upwards from this fold line 9.

Figure 3:
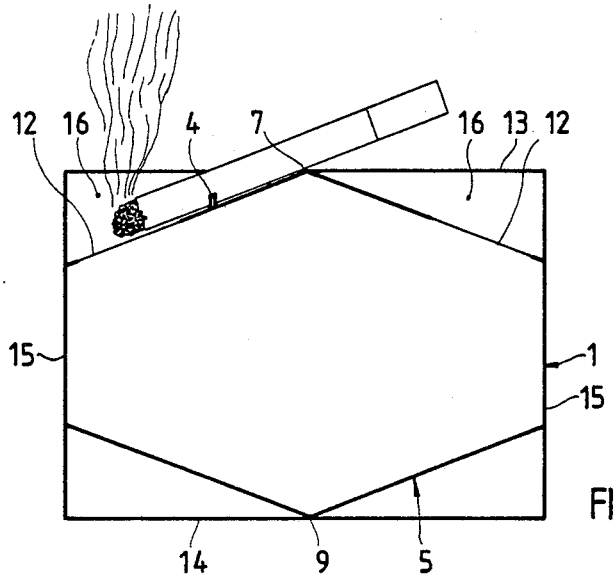
FIG. 3 is a longitudinal vertical section of the receptacle of FIG. 1.
Figure 4:
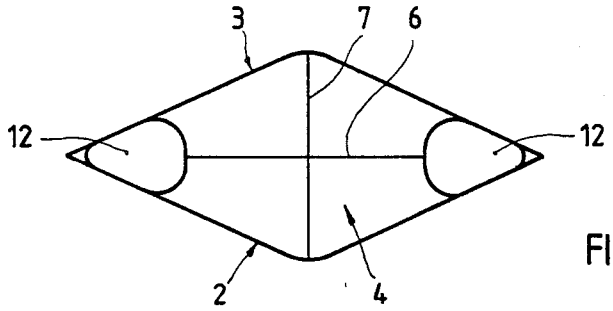
FIG. 4 is a view from above of the receptacle according to FIG. 1.
Figure 5:
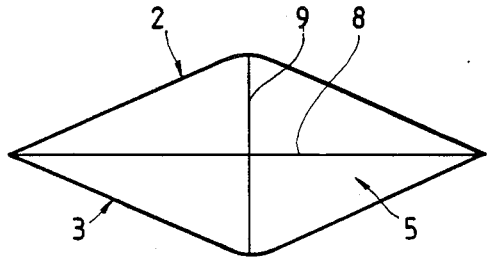
FIG. 5 is a view from below of the receptacle of FIG. 1.

In the top wall 4, in this open position of the receptacle, the two holes 12 then lie at the two lowest places on the wall 4, so that cigarette ash and butts fall through the holes 12 into the interior of the receptacle. Moreover, the two inclined slopes of the top wall 4 provide stable resting surfaces for cigarettes, as shown in FIG. 3, and can serve for stubbing out cigarettes to extinguish them.

To close the holes 12 of the receptacle after use, it is advantageous that applications of contact adhesive should be provided on the regions 16 lying between the upper edges 13 of the side walls 2, 3 and the fold lines 10. These applications of adhesive, after closing of the receptacle by simple pressure exerted on the central parts of the side walls 2, 3, enable one to keep the side walls 2, 3 joined together in the upper part, above the holes 12, by pressure exerted in the locality of the regions 16 coated with adhesive.

Figure 6:
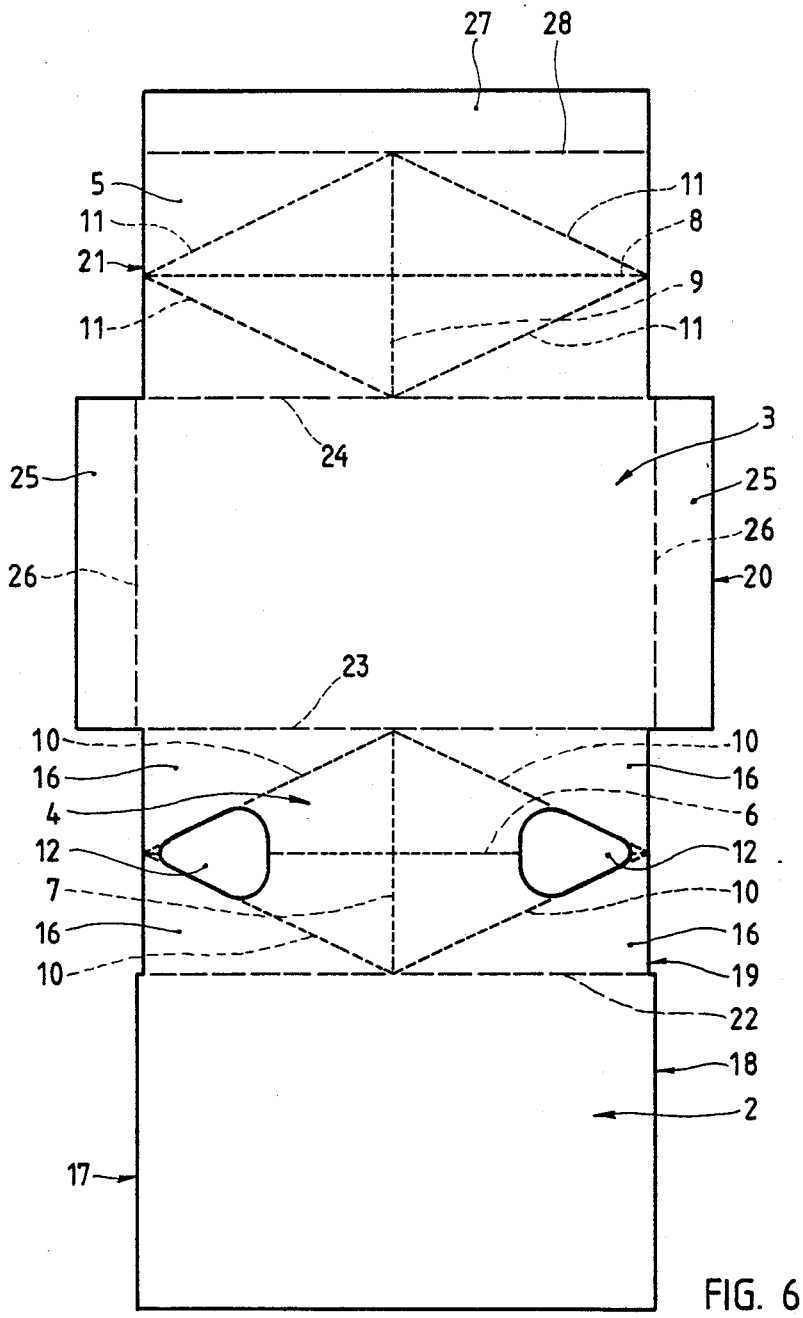
FIG. 6 shows in plan view the development of the receptacle according to the invention.

FIG. 6 shows a blank of thin, flexible material enabling one to produce the receptacle according to FIGS. 1 to 5 by folding and sticking.

The blank 17, of generally rectangular shape, is divided into four rectangular panels 18, 19, 20, 21 connected to each other by their long sides along fold lines 22, 23, 24. The panel 18 corresponds to the side wall 2 and the panel 20 to the side wall 3. In the panel 19 there is inscribed a region in the shape of a lozenge corresponding to the top wall 4 with its two fold lines 6, 7, its two holes 12, and its four boundary lines 10 constituted by fold lines. Outside the lozenge-shaped region 4 there remain four triangular regions corresponding to the regions 16.

Similarly, the panel 21 contains a lozenge-shaped region corresponding to the bottom wall 5, with its two fold lines 8 and 9 and its four boundary lines 11 constituting fold lines.

The panel 20 is extended, at its two small sides, by two flaps 25 connected to the region corresponding to the wall 3 by two fold lines 26 corresponding to the edges 15 of the receptacle.

The panel 21 is extended, at its free longitudinal edge, by a flap 27 connected to the panel 21 by a fold line 28 corresponding to one of the edges 14, the other edge being constituted by the fold line 24. The fold lines 22 and 23 correspond to the edges 13 of the receptacle.

In order to make up the receptacle, starting from the blank according to FIG. 6, the panel 18 is folded against the panel 20, while folding the two panels 19 and 21 on themselves like a bellows, along the lines 6, 8, and between the panels 18 and 20 along the lines 22, 23, 24, and while sticking the two flaps 25 of the panel 20, and also the flap 27 of the panel 21 to the panel 18.

It goes without saying that the embodiment shown and described has only been given as an example, illustrative and not limitative, and that numerous modifications and variations are possible within the scope of the invention.

Thus, the receptacle according to the invention can not only serve as an ashtray, in which case it is made of a non-flammable material, for example fire-resistant paper or card, preferably covered with an aluminum foil, but equally for example as a disposable waste bin, in which case the receptacle is made in a larger size and can be made for example of a thicker material, for example of cardboard, preferably waterproofed.

In addition, especially in the case of use as a waste bin, the receptacle can be higher than it is wide, that is it can be made with side walls (2, 3) which are higher than they are wide.

The receptacle according to the invention, when in the format of an ashtray, can in particular be packaged in a pack containing several receptacles, and able to be slipped into a pocket, like packs of paper handkerchiefs.

We claim:

1. A receptacle, particularly an ashtray or waste bin, comprising a collapsible envelope of thin flexible sheet material and including two confronting sidewalks each having two spaced apart vertical edges with each vertical edge of one sidewall connected to one vertical edge of the other sidewall, each sidewall further having an upper and a lower edge; and a top wall between and adjacent said upper edges, said top wall having a longitudinal fold line extending between said vertical edges and a transverse fold line intermediate said vertical edges and substantially normal to said longitudinal fold line, said top wall including a first substantially triangular portion sloping downwardly from said transverse fold line toward one of said vertical edges and a second substantially triangular portion sloping downwardly from said transverse fold line toward the other of said vertical edges.

2. The receptacle of claim 1, wherein at least one of said triangular portions has an opening.

3. The receptacle of claim 1, wherein said opening is adjacent the respective vertical edge.

4. The receptacle of claim 1, wherein said triangular portions together form a substantially diamond-shaped body.

5. The receptacle of claim 1, further comprising a bottom wall between and adjacent said lower edges, said bottom wall being a mirror image of said top wall.

6. The receptacle of claim 1, wherein said sheet material consists of or contains fire-resistant paper.

7. The receptacle of claim 1, wherein said sheet material consists of or contains waterproof cardboard or paper.

8. The receptacle of claim 1, wherein said top edges of said sidewalls have medium portions which are spaced apart from each other in the region of said transverse fold lines said top wall being collapsible by folding it along said longitudinal fold line to thus halve each of said triangular portions and to move the median portions of said upper edges close to each other.

9. The receptacle of claim 1, wherein said top wall further includes two pairs of additional triangular portions with each pair of additional triangular portions flanking one of said sloping triangular portions, one additional triangular portion of each pair being adjacent the one of said sidewalls and the other additional triangular portion of each pair being adjacent the other of said sidewalls.

10. The receptacle of claim 8, wherein each of said additional triangular portions is bonded to the respective sidewall.

11. The receptacle of claim 1, wherein said transverse fold line is disposed at the level of said upper edges.

* * * * *